US006505734B2

(12) United States Patent
Su

(10) Patent No.: US 6,505,734 B2
(45) Date of Patent: Jan. 14, 2003

(54) CONTAINER WITH LIGHT AND SOUND EMITTING FUNCTION

(75) Inventor: Chin-Lai Su, Yung Kang (TW)

(73) Assignee: Wea Bor Co., Ltd., Tainan Hsien (TW)

( * ) Notice: Subject to any disclaimer, the term of this patent is extended or adjusted under 35 U.S.C. 154(b) by 0 days.

(21) Appl. No.: 09/878,226

(22) Filed: Jun. 12, 2001

(65) Prior Publication Data

US 2002/0185388 A1 Dec. 12, 2002

(51) Int. Cl.[7] ..... B65D 77/00; G08B 21/00

(52) U.S. Cl. ..... 206/217; 206/457; 220/710.5; 446/74; 446/404; 362/101; 40/324; 340/620; 340/692; 340/384.7; 340/815.69

(58) Field of Search ..... 206/217, 457, 206/527; 215/228, 230, 386; 220/212.5, 694, 703, 710.5; 446/74, 267, 397, 404, 485; 362/101, 800, 806; 40/324; 340/620, 692, 384.1, 384.7; 34/815.69

(56) References Cited

U.S. PATENT DOCUMENTS 2,663,866 A * 12/1953 Simpson ..... 200/51.12
3,781,840 A * 12/1973 Roberts et al. ..... 340/620
4,796,017 A * 1/1989 Merenda ..... 324/694
5,070,539 A * 12/1991 Cheng ..... 220/737
5,536,196 A * 7/1996 Sternberg ..... 206/217
5,739,758 A * 4/1998 Driska et al. ..... 215/235
6,037,872 A * 3/2000 Dunnum ..... 215/11.2
6,098,794 A * 8/2000 Lin ..... 206/217
6,163,248 A * 12/2000 Paek et al. ..... 340/321
6,334,271 B1 * 1/2002 Su Yeh ..... 220/62.14
6,406,348 B1 * 6/2002 Pearce ..... 215/11.1

* cited by examiner

*Primary Examiner*—Mickey Yu
*Assistant Examiner*—Jila M Mohandesi
(74) *Attorney, Agent, or Firm*—Rosenberg, Klein & Lee

(57) ABSTRACT

A container with sound and light emitting function includes a containing body, a handle attached to the containing body and an electric circuit. The electric circuit includes speakers, light emitting equipments, two projecting contacts and an IC. The light emitting equipments are attached to outer side of the containing body. The projecting contacts pass through a respective through hole of the containing body into the inner space of the containing body so that same can get into contact with each other electrically to complete the electric circuit for the IC to activate the speakers and the light emitting equipments to send out sound and light when drinks are poured into the containing body to submerge both of the projecting contacts.

3 Claims, 6 Drawing Sheets

CONTAINER WITH LIGHT AND SOUND EMITTING FUNCTION

BACKGROUND OF THE INVENTION

The present invention relates to a container, and particularly to one which is provided with an electric circuits, a speaker, and light emitting equipments for emitting sound and light so that the container is relatively attractive and is interesting to use.

Many efforts have been made to make containers more attractive and interesting so that the containers have more popularity in the market. Referring to FIG. 6, a drinks container is provided with light and sound emitting device; the container includes a round containing member 10, a base member 20, a support leg 30, mercury 40, a photo resistor 50 and an electric circuit 80. The bottom of the round containing member 10 is connected to the top end of the support leg 30, and is provided with a vacuum room 101 having a substantially inverted-cone-shaped central lower part. The support leg 30 is hollow, and has a round hole 60 in the upper end portion. A photo resistor 50 is disposed in the round hole. Mercury 40 is movably received in the vacuum room 101. The electric circuit 80 is secured to a bottom lid 70 of the base member 20, and received in the base member 20. Wires (not numbered) are passed through the support leg 30 to electrically connect the photo resistor 50 to the electric circuit 80. The electric circuit 80 has a speaker, LED (light emitting diode) and a circuit board. When the container is moved to a sloping position in use, the mercury will move away from the inverted-cone-shaped central lower part of the vacuum room 101, permitting light to come into contact with the photo resistor 50 for electricity to be able to pass through the photo resistor 50. Thus, the speaker sends out sound, and the LED emits light. When the container is moved back to an upright position, the electric circuit 80 is cut off because the mercury moves back to the central lower part of the vacuum room 101.

The container is attractive and interesting to use, however, it is difficult for the mercury to move to the position needed for activating the electric circuit because of the inverted-cone-shape of the central lower part of the vacuum room 101, especially when the level of the drink in the containing 10 is relatively high.

SUMMARY OF THE INVENTION

Therefore, it is a main object of the present invention to provide a container with light and sound emitting function which is relatively easy to use as compared with the conventional one.

The container with sound and light emitting function of the present invention includes a containing body, a handle, and an activating electric circuit, which has two projecting contacts, speakers, several light emitting equipments and an IC.

The handle is attached to the containing body. The activating electric circuit is disposed in a receiving room of the handle with the projecting contacts passing through a respective through hole of the containing body into the inner space of the containing body. The light emitting equipments are attached to the outer side of the containing body.

When drinks are poured into the containing body to submerge both of the projecting contacts, the contacts get into contact with each other electrically to complete the activating electric circuit for the IC to activate the speakers and the light emitting equipments to send out sound and light respectively.

The container can also be made in the form of a cocktail shaker; the shaker has an intermediate lid detachably connected to a containing body. A transparent top lid has an activating electric circuit of the same kind attached to; the projecting contacts will be submerged by drinks flowing through holes of the intermediate lid to get into contact with each other electrically to complete the activating electric circuit when the shaker is shaken to mix the drinks contained in it.

BRIEF DESCRIPTION OF THE DRAWINGS

This invention will be better understood by referring to the accompanying drawings, wherein.

DETAILED DESCRIPTION OF THE PREFERRED EMBODIMENTS

Figure 1:
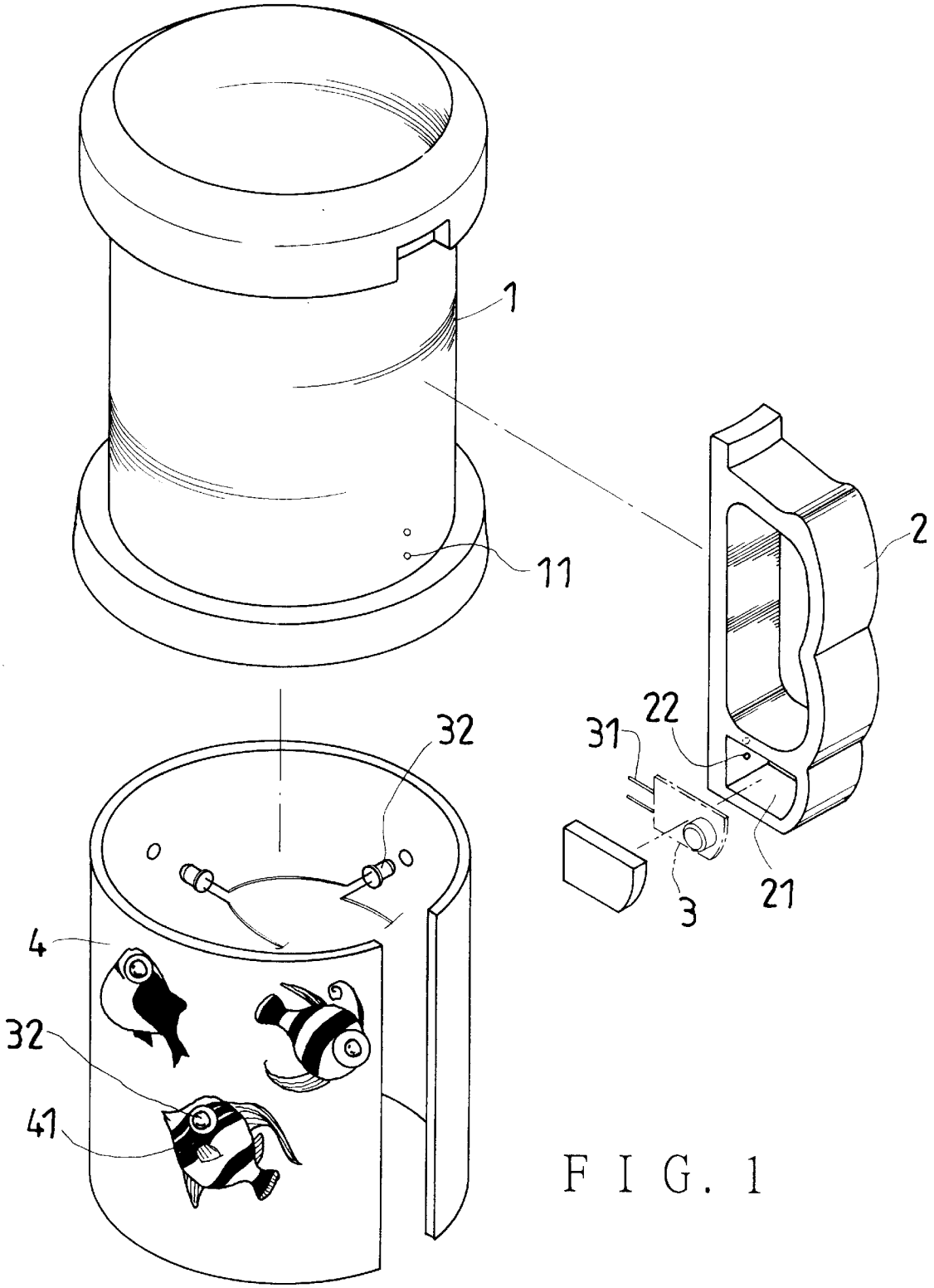
FIG. 1 is an exploded perspective view of a drinks container with sound and light emitting function according to the present invention.
Figure 2:
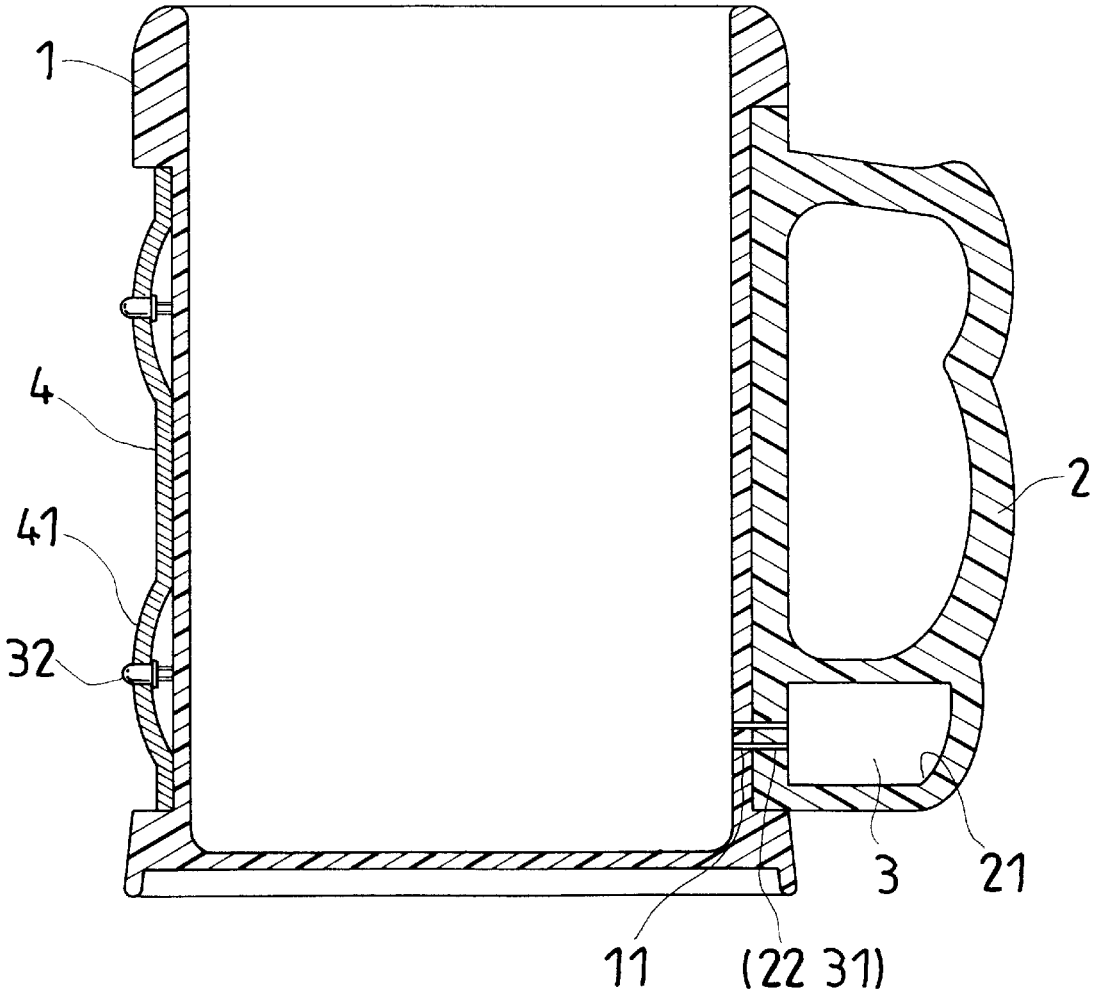
FIG. 2 is a cross-sectional view of the drinks container with sound and light emitting function in FIG. 1.

Referring to FIGS. 1 and 2, a container with sound and light emitting function of the present invention includes a containing body 1, a handle 2, an activating electric circuit 3 and a surrounding member 4. The container can be a cup or a beer mug.

The containing body 1 has an empty space in it for containing drinks or other conductive liquids, and has two through holes 11 on the lateral side. The handle 2 has a receiving room 21, and two through holes 22, and is attached to the containing body 1 with the through holes 22 being aligned with a respective one of the through holes 11 of the containing body 1.

The surrounding member 4 is disposed around the containing body 1 except the part of the containing body 1 connected to the handle 2. The surrounding member 4 has prints 41 on it.

Figure 3:
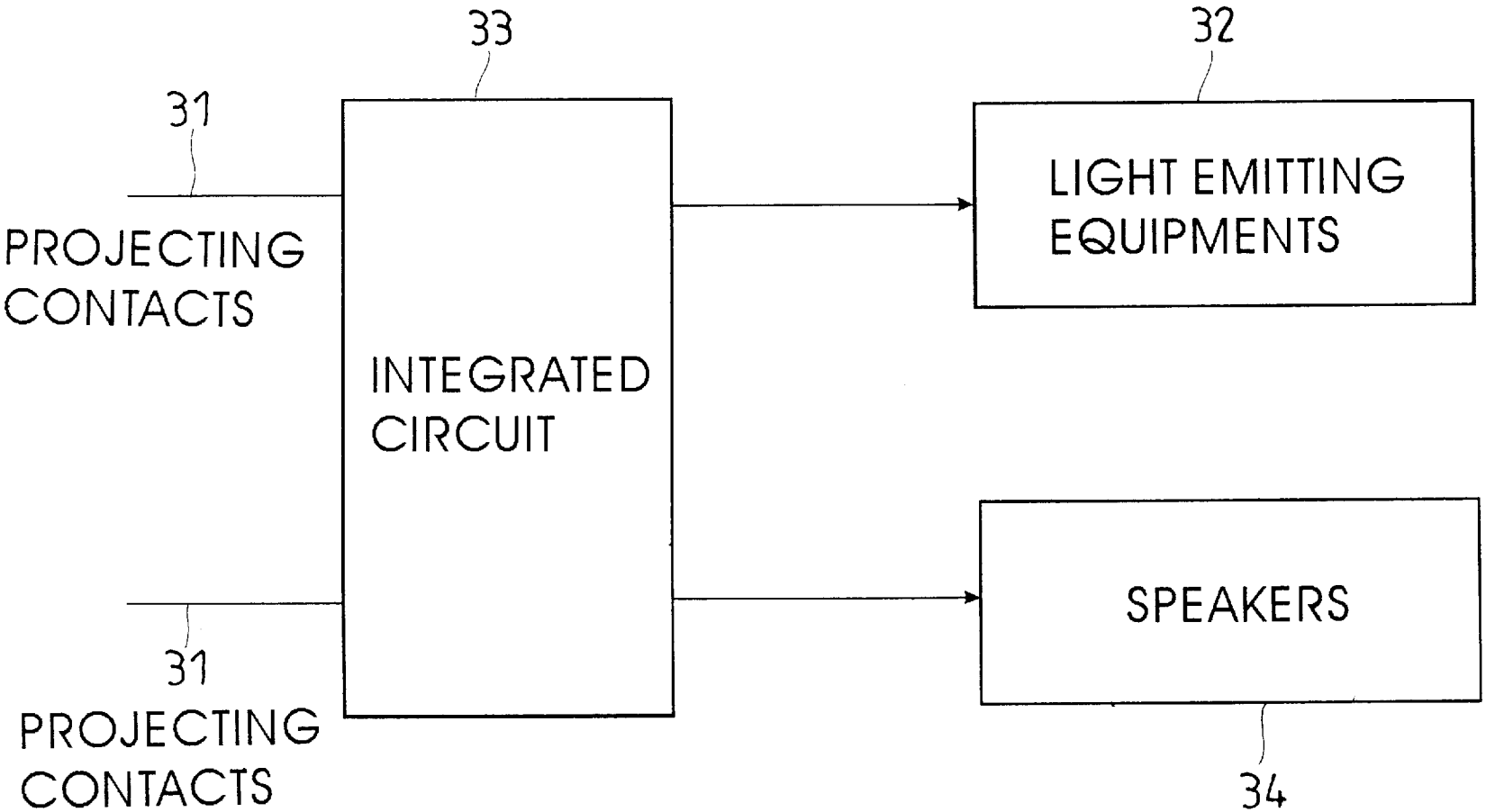
FIG. 3 is a circuit diagram of the electric circuit of the drinks container with sound and light emitting function according to the present invention.
Figure 4:
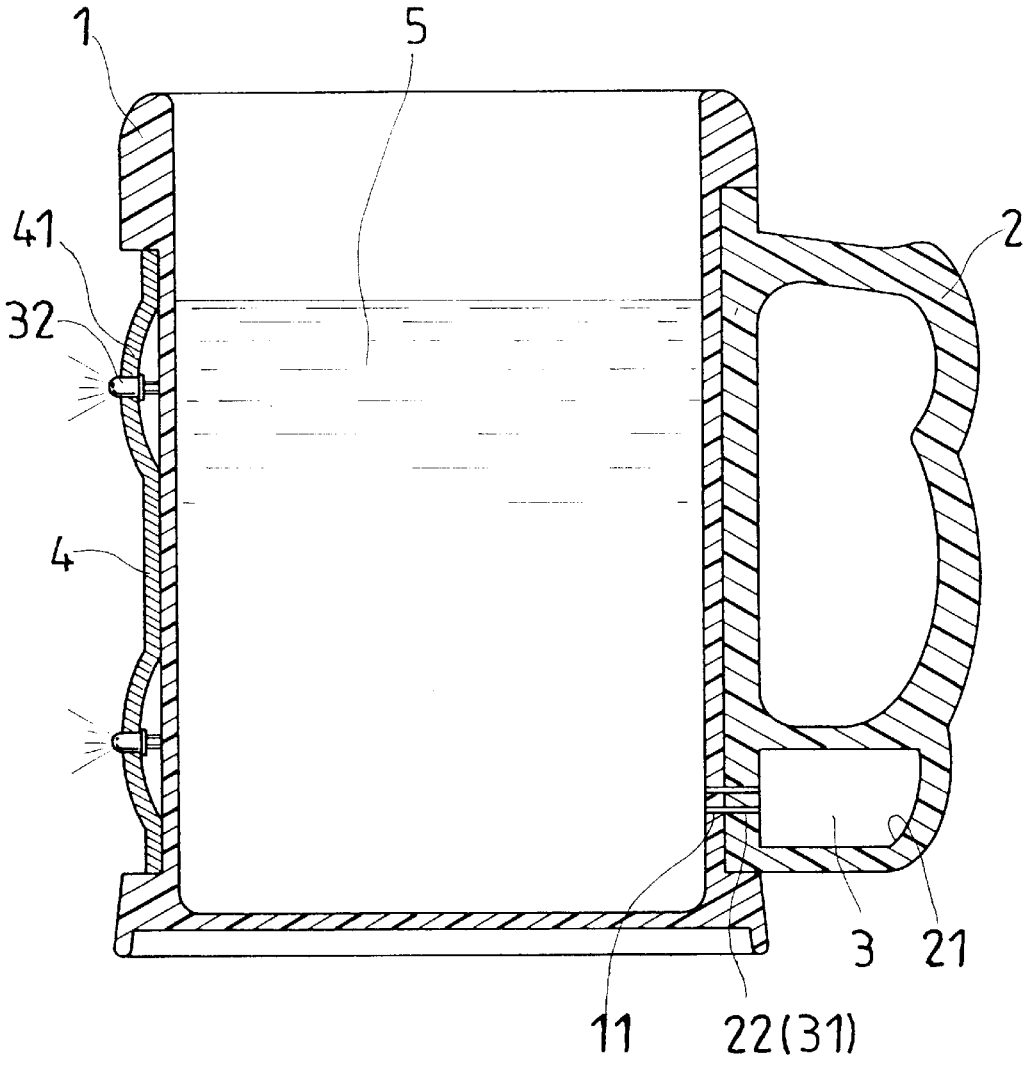
FIG. 4 is a cross-sectional view of the drinks container with sound and light emitting function in working condition.

Referring to FIG. 3, the activating electric circuit 3 includes two projecting contacts 31, several light emitting equipments 32, an IC (integrated circuit) 33 and speakers 34. The activating electric circuit 3 is disposed in the receiving room 21 of the handle 2 with the projecting contacts 31 passing through the through holes 22 and 11 to stick out from the inner side of the containing body 1.

The light emitting equipments 32 are secured to holes (not numbered) of the surrounding member 4. If the prints 41 on the surrounding member 4 are animals such as fish, the light emitting equipments 32 can be secured to the eyes of the animals to make the prints 41 look further interesting when the equipments 32 emit light.

The projecting contacts 31 are provided to work as a switch for the activating electric circuit 3; when drinks 5 or other conductive liquid are poured into the containing body 1 to a level where both of the projecting contacts 31 are submerged by the drinks, the projecting contacts 31 get into contact with each other electrically to complete the circuit 3. Thus, the speaker 34 is activated to send out sound and the light emitting equipments 32 light by the IC 33. If the level of the drinks is not high enough to submerge both of the projecting contacts 31, the activating electric circuit 3 can't become a loop and the speaker 34 and the light emitting equipments 32 won't be activated.

Figure 5:
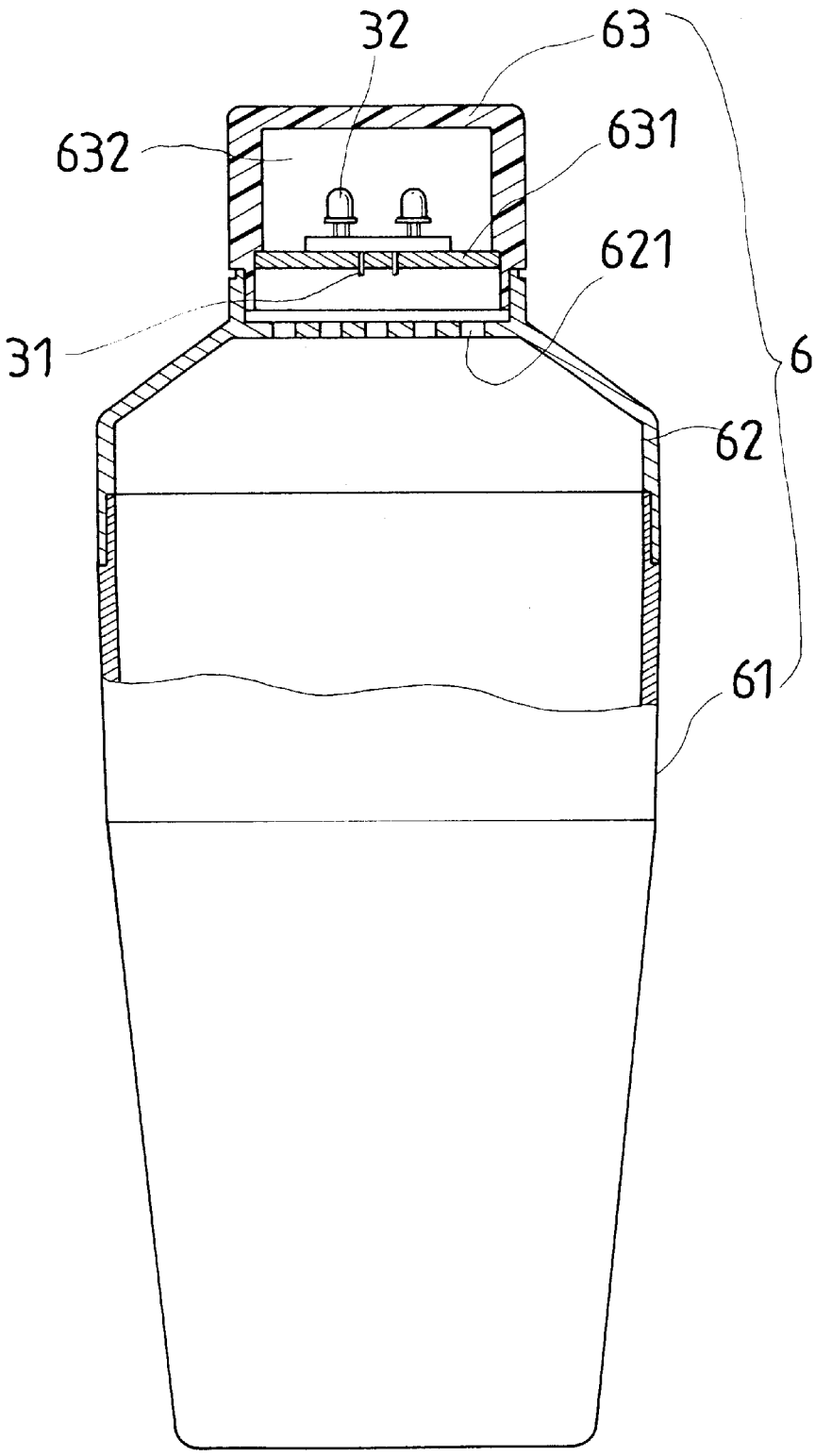
FIG. 5 is a cross-sectional view of the shaker with sound and light emitting function according to the second embodiment of the present invention.
Figure 6:
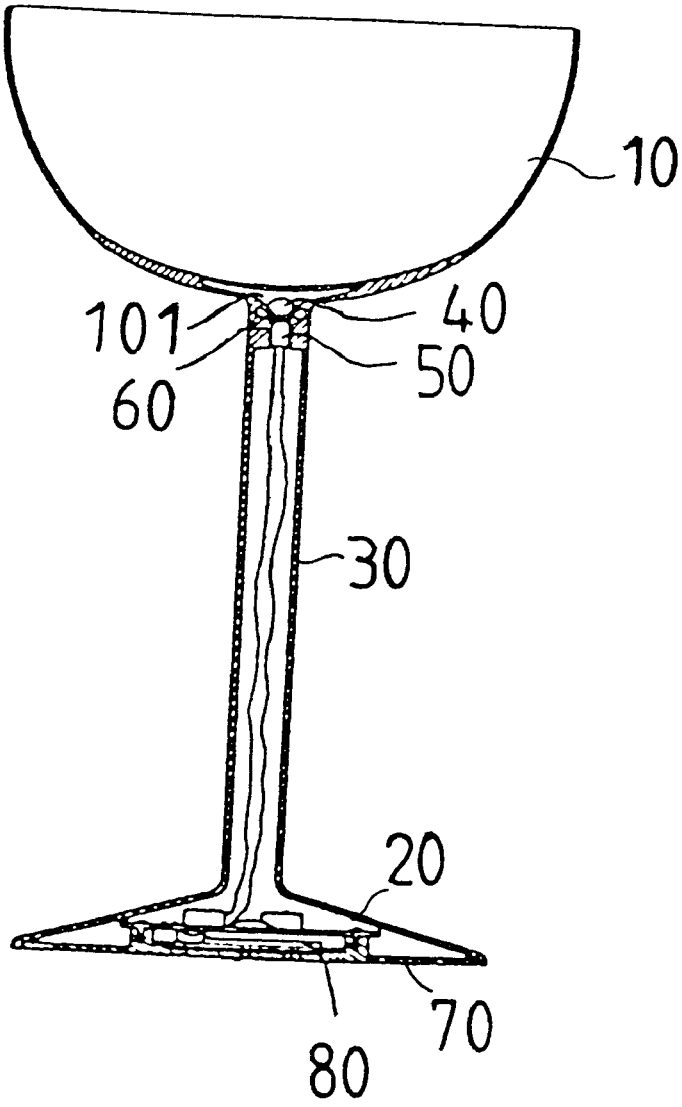
F I G. 6 (PRIOR ART)
FIG. 6 is a cross-sectional view of the conventional drinks container with sound and light emitting function in the Background.

Referring to FIG. 5, a cocktail shaker 6 with light and sound emitting function according to a second embodiment of the present invention includes a main containing body 61, an intermediate lid 62, a top lid 63 and an activating electric circuit 3. The intermediate lid 62 has several through holes 621 on the top end, and is detachably connected to the upper end of the main containing body 61. The top lid 63 is detachably connected to the upper potion of the intermediate lid 62, and is transparent. The top lid 63 has a separating part 631 in it for a receiving room 632 to form between same and the outer side of the top lid 63. The activating electric circuit 3 is disposed in the receiving room 632, and secured to the upper side of the separating part 631 with projecting contacts 31 thereof passing through the separating part 631 to stick out from the bottom of the separating part 631. The activating electric circuit 3 also has IC 33, speakers 34 and light emitting equipments 32; when drinks, fruit juices, liquid fructose and so on in the containing body 61 are mixed by shaking the shaker 6, the mixed drinks will flow through the though holes 621 of the intermediate lid 62 to submerge the projecting contacts 31 so that the contacts 31 get into contact with each other electrically to complete the circuit 3. Thus, the IC 33 activate the speakers 34 and the light emitting equipments 32; light from the light emitting equipments 32 can be easily seen because the top lid 63 is transparent.

Furthermore, the activating electric circuits 3 of both the container 1 and the shaker 6 can be provided with a timer circuit so that the speakers 34 and the light emitting equipments 32 can be cut off after same has been working for a certain period of time.

From the above description, the drinks container with sound and light emitting function of the present invention can be known to have an advantage that the speakers and the light emitting equipments can be activated relatively easily as compared with those of the conventional drinks container in the Background.

What is claimed is:

1. A container with sound and light emitting function, comprising a containing body having an empty space therein; a handle attached to a lateral side of said containing body; said handle having a receiving room receiving an activating electric circuit therein; said activating electric circuit including a plurality of speakers, and two projecting contacts each passing through said handle and a respective through hole of said containing body to project in said empty space of said containing body; said activating electric circuit electrically connected to a plurality of light emitting equipments disposed on said containing body, and having an integrated circuit for activating said speakers and said light emitting equipments to send out sound and light respectively when conductive liquids are poured into said containing body to submerge both of said projecting contacts for said projecting contacts to get into contact with each other electrically to complete said activating electric circuit.

2. The container with sound and light emitting function as claimed in claim 1 being a cup provided for containing drinks.

3. The container with sound and light emitting function as claimed in claim 1 further having a surrounding member disposed around said containing body; said surrounding member having a plurality of prints thereon with said light emitting equipments being passed through holes thereof.

* * * * *